US012582181B2

(12) United States Patent
Butler

(10) Patent No.: US 12,582,181 B2
(45) Date of Patent: Mar. 24, 2026

(54) SENSORY HOODIE

(71) Applicant: Katina Stone Butler, Denton, TX (US)

(72) Inventor: Katina Stone Butler, Denton, TX (US)

( * ) Notice: Subject to any disclaimer, the term of this patent is extended or adjusted under 35 U.S.C. 154(b) by 0 days.

(21) Appl. No.: 18/736,463

(22) Filed: Jun. 6, 2024

(65) Prior Publication Data

US 2024/0407489 A1 Dec. 12, 2024

Related U.S. Application Data

(60) Provisional application No. 63/471,301, filed on Jun. 6, 2023.

(51) Int. Cl.
*A41D 3/00* (2006.01)
*A41D 27/10* (2006.01)

(52) U.S. Cl.
CPC ..... *A41D 27/10* (2013.01); *A41D 3/00* (2013.01); *A41D 2200/20* (2013.01); *A41D 2300/33* (2013.01)

(58) Field of Classification Search
CPC ..... A41D 27/10; A41D 27/20; A41D 27/22; A41D 1/04; A41D 1/02; A41D 11/00; A41D 2200/20
See application file for complete search history.

(56) References Cited

U.S. PATENT DOCUMENTS 782,125 A * 2/1905 Gentry ..... A41D 1/02 2/96
2,994,091 A * 8/1961 Aftergood, Jr. ..... A41F 9/025 2/243.1
3,484,974 A * 12/1969 Culmone ..... A41D 27/08 2/244
3,698,014 A * 10/1972 Little ..... A41D 3/00 2/202
3,950,789 A * 4/1976 Konz ..... F25D 3/14 2/81
4,057,854 A * 11/1977 Phelps, Sr. ..... A45F 5/00 2/128
4,334,326 A * 6/1982 Mallow ..... A45F 5/022 2/249
4,347,629 A * 9/1982 Itoi ..... A45F 4/12 2/108

(Continued)

*Primary Examiner* — Jillian K Pierorazio
(74) *Attorney, Agent, or Firm* — Kandace D. Walter

(57) ABSTRACT

The present invention discloses an adjustable and modifiable garment for the treatment of sensory and neuro-divergency conditions that can treat a significant number of issues for different wearers with discretion from possibly judgmental third parties. The invention combines a hoodie with drawstrings, torso covering, compression sleeves, thumb holes, pocket, hem band with adjustable elements, and fidget toy attachments. The invention is comprised of a hoodie with weighted insert panels of variable weights, adjustment mechanisms for the compression or tightness of the garment; food-grade silicone coated hoodie strings for safe chewing; a hood rise used as a face covering; flat felled, serged, and fully lined seams to prevent irritation; thumbholes for additional comfort and grip; invisible seams to hide weighted panel inserts; hidden silicone beads for fidgeting inside the front pocket; and heat transfer labels (replacing scratchy tags sewn into garments) to prevent itching and provide comfort to the wearer.

10 Claims, 8 Drawing Sheets

(56) References Cited

U.S. PATENT DOCUMENTS 4,407,497 A * 10/1983 Gracie ..... A63B 21/065 2/912
4,637,075 A * 1/1987 Ingrisano ..... A61F 17/00 2/253
4,860,388 A * 8/1989 Dean ..... A41D 13/012 2/106
4,989,267 A * 2/1991 Watson ..... A63B 21/065 2/2.5
5,014,359 A * 5/1991 Hanson ..... A45F 4/12 2/102
5,054,127 A * 10/1991 Zevchak ..... A41D 27/20 2/250
5,144,694 A * 9/1992 Conrad Da oud ... A63B 21/065 D2/737
5,546,620 A * 8/1996 Matthews ..... A47D 13/08 5/639
5,742,939 A * 4/1998 Williams ..... A41D 13/015 446/28
5,815,834 A * 10/1998 Bronson ..... A41B 13/10 2/102
6,209,135 B1 * 4/2001 Irvin ..... A63B 21/065 2/102
6,405,376 B1 * 6/2002 Falk ..... A41D 31/102 2/102
6,665,879 B2 * 12/2003 VandenBerg ..... A63B 21/065 2/102
6,692,413 B1 * 2/2004 Greenberg ..... A63B 21/4001 2/108
9,089,169 B1 * 7/2015 Covo ..... A41D 1/04
10,932,504 B1 * 3/2021 Gillam ..... A41D 13/0012
11,246,360 B1 * 2/2022 Hanson Allen ..... A41B 9/06
11,412,787 B1 * 8/2022 Galustyants ..... A41D 1/04
2004/0083529 A1 * 5/2004 Tate ..... A41D 13/0015 2/115
2004/0144481 A1 * 7/2004 Poulos ..... A41D 27/08 156/230
2007/0017001 A1 * 1/2007 Wagner ..... A41D 11/00 2/102
2009/0235426 A1 * 9/2009 Johnston ..... A41D 3/005 2/139
2010/0024100 A1 * 2/2010 Sokolowski ..... A41D 13/0562 2/455
2012/0023639 A1 * 2/2012 Rojas Mas ..... A42B 1/048 2/84
2013/0247277 A1 * 9/2013 Turbovich ..... A63H 33/006 2/243.1
2014/0047614 A1 * 2/2014 Becton ..... A41D 1/04 2/84
2014/0096305 A1 * 4/2014 Friesen ..... A41D 1/04 2/84
2015/0335853 A1 * 11/2015 Orewiler ..... A61F 5/50 128/869
2016/0374415 A1 * 12/2016 Chang ..... A41D 15/00 2/69
2018/0000171 A1 * 1/2018 Pacheco ..... A61M 21/02
2018/0092410 A1 * 4/2018 Rundle ..... A41D 3/08
2018/0368488 A1 * 12/2018 Rundle ..... A41D 3/08
2019/0060604 A1 * 2/2019 Smith ..... A41D 1/06
2019/0104775 A1 * 4/2019 Wood ..... A41D 3/00
2021/0030074 A1 * 2/2021 Paradis ..... A61M 21/02
2021/0289864 A1 * 9/2021 Obletz ..... A41D 13/0012
2021/0345700 A1 * 11/2021 Krulik ..... A47K 5/1211
2022/0151310 A1 * 5/2022 Jorgensen ..... A41D 27/08
2022/0379072 A1 * 12/2022 Gangan ..... A61M 21/02
2023/0058732 A1 * 2/2023 Bourget Fussy ..... A63H 5/00
2023/0077610 A1 * 3/2023 Williams ..... A47G 9/0223 2/69.5

* cited by examiner

SENSORY HOODIE

FIELD OF THE INVENTION

The present disclosure relates to apparel for the treatment of various sensory and neuro-divergency medical conditions.

BACKGROUND

People with sensory, mental health and various neurodivergent needs, such as ADHD, ASD, ADD, Sensory and Psychological disorders affecting the skin, Behavioral or psychological disturbance, Depression, and Anxiety. may experience tactile hypersensitivities to various types of clothing. These issues can cause physical, cognitive, and psychosocial limitations that leave these individuals seeking mechanisms to provide comfort, which can include certain articles of clothing. Discussions and work surrounding the mental health needs of the greater society gained significant exposure during the pandemic. Addressing social isolation and experiences individuals weathered during the pandemic illuminated society's needs for addressing individual emotional well-being and mental health, which includes individuals with already previously diagnosed or identified limitations. The development of garments that seek to heal and assist individuals with emotional regulation and provide connection to self and others is a relatively new concept (Meinert, 2023). Products have been developed over the years to address the needs of individuals diagnosed with autism spectrum disorder (ASD). The pivotal work by Dr. Temple Grandin identified the calming effects that deep pressure touch on children with ASD and Attention Deficit Hyperactivity Disorder (ADHD) provided (Meinert, 2023). Research has identified the benefits of self-soothing sensory friendly apparel, however, each person has a unique set of symptoms and ailments that may not be addressed adequately by a single article of sensory clothing (Meinert, 2023).

Many of the currently available options are visually distinguishable by the general public, which may create a potentially negative stigma for the wearer of sensory clothing items. Additionally, some sensory garments may only address one or two symptoms, limiting their effectiveness for a wearer who would be best treated with multiple sensory issues. The conceptualization of Sensory Hoodie was identified by a parent seeking to develop a sensory garment to assist a family member suffering from emotional dis-regulation, sensory, mental health and other neurodivergent issues.

The overall goals of Sensory Hoodie are improving the health and well-being of wearers with the overall aim to address a majority of the well-known sensory limitations experienced by individuals with sensory differences associated with mental health and neurodivergent limitations and focusing on style and quality of materials while simultaneously aimed at reducing social stigma The present invention is a sensory soothing garment to serve as an aid and coping mechanism that may be used and worn in public while maintaining a sense of privacy and dignity for the wearer who may not wish to disclose their limitations to others.

The present invention incorporates elements, including but not limited to: hoodie with weighted inserts (weights can vary according to needs of individual), sleeve inserts constructed with compression fabric, mechanisms for the easy adjustment of compression of the garment, food-grade silicone coated hoodie strings for safe chewing, oversized hood for the reduction of friction against the body, flat felled, serged, and lined seams to prevent irritation of skin from seams, thumbholes for additional comfort and grip, invisible seams to hide weighted panel inserts, hidden silicone toys for fidgeting inside front pocket, loop attachment points to customize fidget toy placement, reflective logos for safety purposes and nighttime wearing, heat transfer labels to prevent itching. Further, specialty features such as the flat felled seams are sewn with seams finished on the outside of the garment, instead of on the inside, which prevents possible irritation of the wearer's skin. Serged seams have a clean finish on the raw edges by using multiple threads on a five thread overlock machine.

OBJECTIVES

An object of one embodiment of the present disclosure is to provide an adjustable garment for compression, weightedness and fidget relief to relieve various mental health conditions.

Another object of the present disclosure is to provide discreet relief for sensory disorders that cannot easily be identified by third parties.

Another object of the present disclosure is to provide multiple forms of relief for sensory disorders in a single garment resulting in a garment that can be used by persons with various ailments.

Another object of the present disclosure is to provide a durable garment that withstands chewing and other potentially destructive behaviors by the wearer.

Another object of the present disclosure is to provide an adjustable garment that can be modified for different users and well as different needs of a single user.

Another object of the present disclosure is to provide a garment that provides a sense of solitude for a user with an optional hoodie rise face covering.

SUMMARY

The present invention relates to an adjustable and modifiable garment for the treatment of sensory and neurodivergency conditions, the "Sensory Hoodie". The Sensory Hoodie combines the traditional elements, hoodie with drawstrings, torso covering, sleeves, and hem band, with adjustable elements to address sensory and neuro-divergency conditions. This particular embodiment of the Sensory Hoodie incorporates elements, including but not limited to: hoodie with weighted inserts of variable weights; sleeve inserts constructed with compression fabric; adjustment mechanisms for the compression or tightness of the garment; food-grade silicone coated hoodie strings for safe chewing; oversized hood; flat felled, serged, and fully lined seams to prevent irritation; thumbholes for additional comfort and grip; invisible seams to hide weighted panel inserts; hidden silicone toys for fidgeting inside front pocket; loop attachment points to customize fidget toy placement, reflective logos for safety purposes; and heat transfer labels to prevent itching. However, it is to be understood that the same systems may be utilized for other items of clothing and apparel.

The head/face portion of the present invention, the portion of the garment above the shoulder area, includes an oversized hood, hood face opening with hood rise, hood drawstrings, lining, ribbon loop for fidget toy attachment, and food grade silicone coated drawstring tips for safe chewing. The oversized and loose hood prevents friction between the wearer's head and the fabric of the garment. However, a user may pull on the drawstrings of Sensory Hoodie to make the head portion tighter. The hood face opening is constructed with a hood rise, which is constructed with an angled hood rise that the user can pull up further inside the hoodie face opening and over the wearer's face to provide additional privacy in a public space. The hood drawstrings are of a high-quality material that will withstand pressure, friction and chewing. The hoodie drawstring tips are made of food-grade silicone or a similar material to prevent destruction of the tips from the hoodie wearer's chewing. The hoodie head portion also includes loops, which may serve as fidget devices themselves or as an attachment material for an external fidget device. The remaining portion of this Sensory Hoodie garment is comprised of the torso section and the sleeves.

The arm/sleeve portion of the present invention includes a pair of sleeves, zip openings along upper arm with removable compression inserts, zipper pulls for invisible sleeve openings, sleeve thumb holes, sleeve hem. To increase the compression inside the Sensory Hoodie, a wearer may choose to insert the arm compression bands or panels inside the Sensory Hoodie sleeve. The sleeve may be opened by pulling the zipper pull of the sleeve to open the sleeve. Once opened, the arm compression panel may be snapped into the interior portion of the sleeve and the zipper pull used to close the sleeve section of the Sensory Hoodie. The arm panels use connectors on the sleeve seam with a wide knit compression band inside the arm panel. The wearer can choose to leave the arm panel without the compression band for an oversized fit, or insert through an invisible zipper seam (which is opened by tugging on the zipper pull) and secure with a snap to wear the additional sleeve for desired compression around the arm area as needed.

The wrist opening at the exterior edge of each arm panel may contain thumb openings to add additional security and comfort for the wearer. Users may experience comfort by covering the majority of their hand with the arm panel and revealing only their thumb through the thumb opening. The wrist openings or sleeve hems of the sleeves are made of oversized elastic to prevent tightness or friction against the user's skin.

The torso portion of the present invention has distinct elements at the upper torso (hidden weight insert and sleeve/arm compression attachment) and the lower torso area (front pocket area). The Sensory Hoodie torso portion includes front torso covering, back torso covering, invisible zippers, weighted yoke inserts on chest between self (outside fabric) and lining (fabric inside garment) and lower section pocket with fidget loops, bottom hem band, bottom hem band drawstrings. The weighted inserts on the front torso covering and back torso covering may be placed inside the lining of the sensory hoodie through an invisible zipper seam on the outside of the torso covering and attached to the torso covering through hook and loop fasteners, such as Velcro, on the lining of the torso covering and the weighted insert itself to prevent shifting within the torso covering. The weighted panel inserts are constructed of stitched or quilted pockets filled with beads that are of equal measurement in each pocket, adding up to the total amount of weight per insert. The inserts are engineered to have reinforced attachment to withstand long term use for the wearer.

The arm sleeve panels are attached to the torso portion of the Sensory Hoodie. The arm sleeve panel may be opened by wearer tugging on the zipper pull located at the Sensory Hoodie arm sleeve panel's seam. Once the arm sleeve panel is open, the wearer or another person may insert the arm compression sleeve inside the arm sleeve panel. The arm compression sleeve may be attached via an attachment mechanism, a snap device in this embodiment, to the torso section of the Sensory Hoodie. At any time, the wearer may unzip the arm sleeve and remove the arm compression sleeve from the arm panel sleeve. There is a snap inside each arm sleeve of the Sensory Hoodie for securing an arm compression panel to provide additional comfort to the wearer.

The Sensory Hoodie torso front pocket is attached via stitching or other securing means to the forward-facing surface of the front torso covering. While this embodiment utilizes the single needle top stich, similar attachment methods may also be used. The interior of front pocket may contain any variety of fidget toys or gadgets, such as a beaded loop textured materials made of plastics or fabrics, rings, strings or silicone beads. Ribbon loops are located along the neckline seam, inside the hoodie torso pocket, and on the hemline seam to serve as attachment points for the fidget toys, customizable to the wearer's sensory output needs as well as potential discreetness. The drawstrings may be pulled to create a snugger fit for the wearer. The drawstring tips may be chewed without fear of destruction. The ribbon loops, outside the front pocket and hidden inside the front pocket, may be used as fidget toys or as an attachment means for fidget toys.

Additionally, flat felled and fully lined seams prevent itching and scratching of the wearer's skin by being fully encased in the garment. Flat felled seams are constructed by keeping the raw edge of the fabric finished on the outside of the garment, therefore preventing irritation. Fully lined areas of the hoodie, such as the torso and hoodie conceal the raw edges of the seams by encasing them in a soft, breathable fabric. The fidget toys included in the Sensory Hoodie are hidden inside the front torso front pocket. Inside the top stitched pocket, a fabric loop with silicone fidget beads may be sewn to act as a discreet fidget toy as needed by the wearer. The Sensory Hoodie is constructed with a hoodie rise, that aids in covering the Sensory Hoodie wearer's face. The wearer may choose to pull the hoodie rise further up into the face opening to cover more of the wearer's face. The weighted inserts are inserted using the hidden invisible zipper seams on the front and back torso panels, and secured inside the lining of the garment using hook and loop fasteners, such as Velcro. The weighted inserts will be offered to the customer in varying weights depending on the need of the wearer. Users may purchase additional inserts for their Sensory Hoodie at any time. The compression element of the hoodie is customizable to the wearer depending on how tight they pull the drawstring mechanism on the hip, if they wear the removable compression sleeve insert, and if they adjust the hoodie drawstrings utilizing the three-inch neckline rise as a face covering. Additionally, logos on the exterior of the Sensory Hoodie for brand management may be rubberized and reflective as sensory components for fidget management and visual sensory support. Further, tags inside the Sensory Hoodie may be heat transfer in place of traditional sewn tags, to eliminate itching and irritation, for a wearer, traditionally caused by sewn tags.

BRIEF DESCRIPTION OF THE DRAWINGS

For a more complete understanding of this disclosure and its features, reference is now made to the following description, taken in conjunction with the accompanying drawings, in which.

REFERENCE NUMBERS

Figure 1:
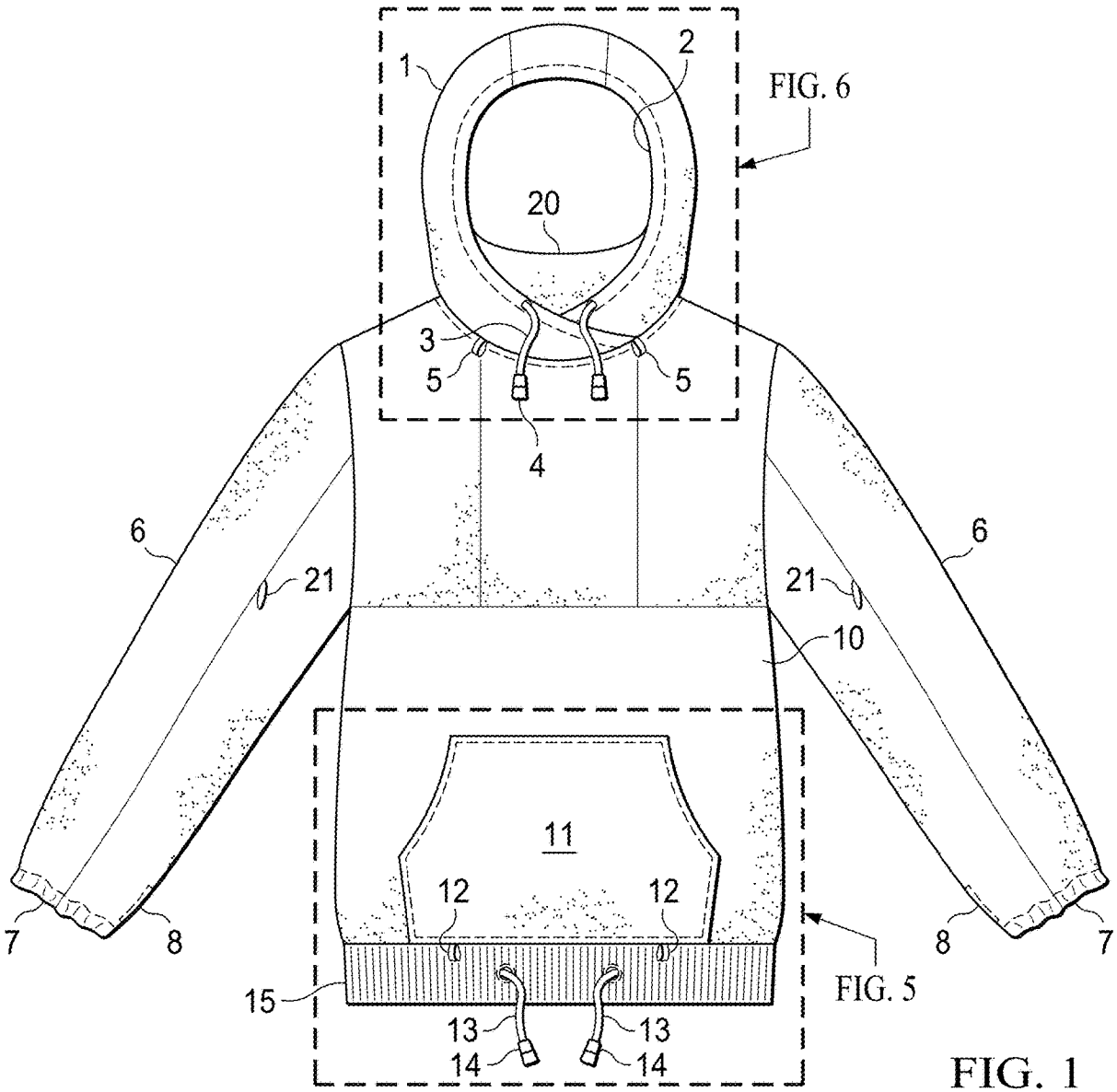
FIG. 1 shows a front view of the Sensory Hoodie product.

1. Hoodie Head component
2. Hoodie face opening
3. Hoodie head drawstring
4. Hoodie head drawstring tip
5. Hoodie head fidget tool
6. Hoodie Arm component
7. Hoodie Arm sleeve hem
8. Hoodie Arm sleeve thumb hole
9. Hoodie Arm compression sleeve
10. Hoodie Torso component
11. Hoodie front pocket
12. Hoodie front pocket fidget tool
13. Hoodie bottom hem drawstring
14. Hoodie bottom hem drawstring tips
15. Hoodie bottom hem (below front pocket)
16. Hoodie Torso attachment means for compression sleeve
17. Hoodie Torso weighted insert panel
18. Hoodie Torso weighted insert attachment means
19. Hoodie Torso weighted insert weight pockets
20. Hoodie rise face covering
21. Hoodie sleeve invisible zipper pulls

DETAILED DESCRIPTION

Figure 5:
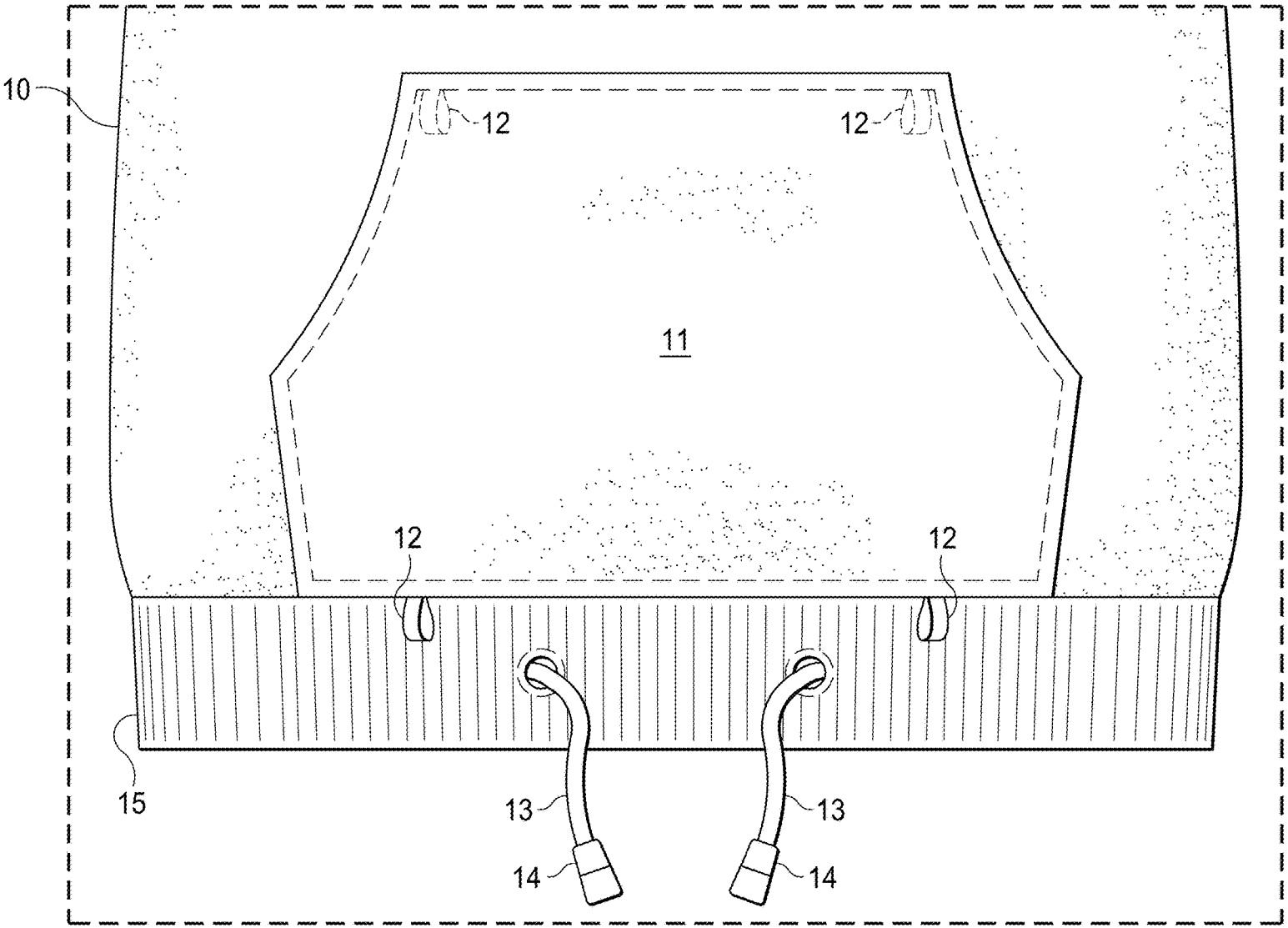
FIG. 5 shows the detail of the hem and front pocket of the Sensory Hoodie.
Figure 6:
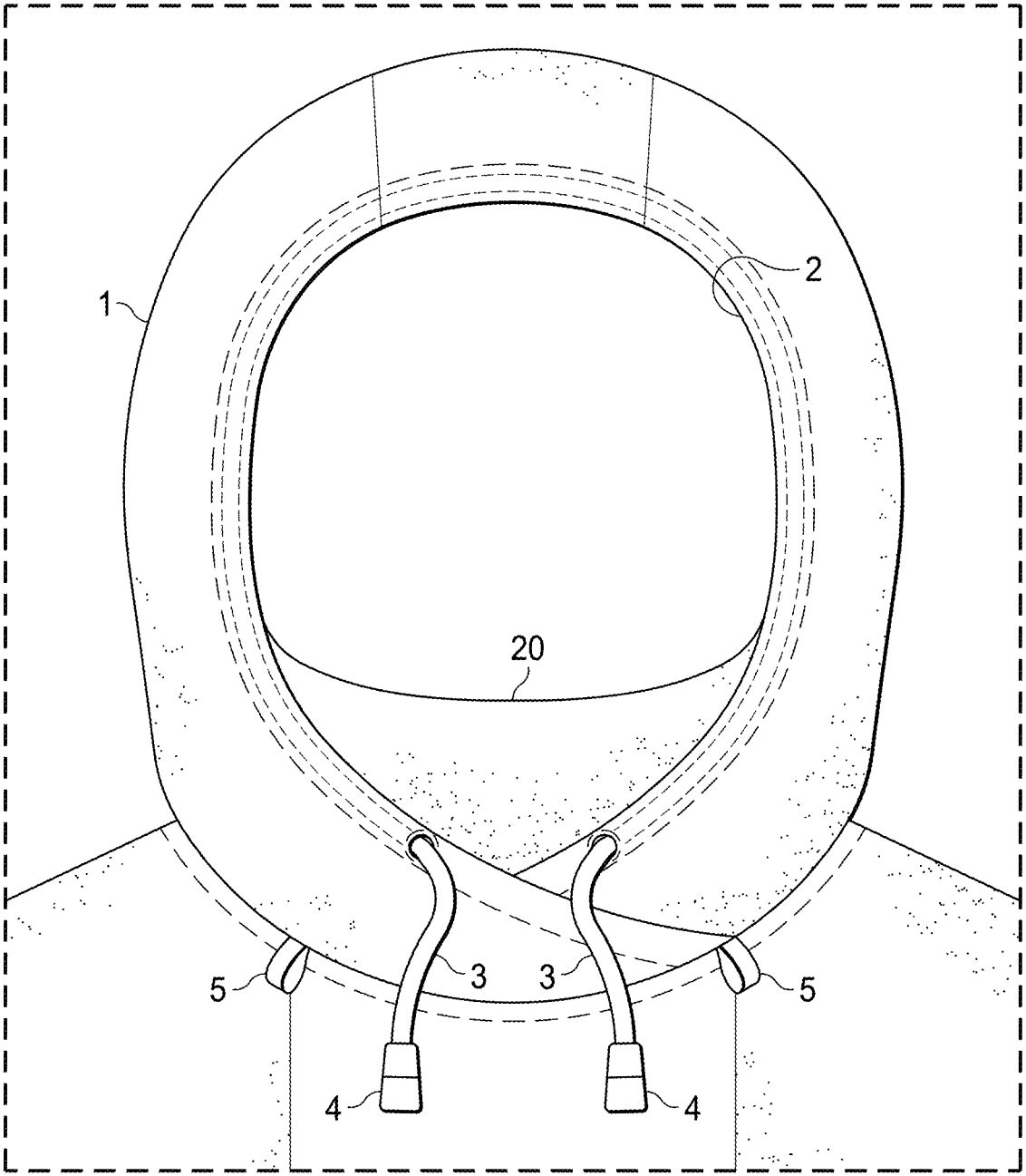
FIG. 6 shows the detail of the hood opening and drawstrings of the Sensory Hoodie.

The present disclosure is an apparel item with various elements incorporated to address sensory and neurodivergent needs of the wearer. FIG. 1 shows a front view of the Sensory Hoodie product, featuring the head component 1, arm component 6 and torso component 10. In this view, the front of the hoodie is shown with drawstrings near the face opening 2 of the Sensory Hoodie. The hoodie rise face 20 covering is above the bottom of the face opening 2 and the head drawstrings 3. The drawstring tips 4 are at the far end of the drawstrings. A pair of head fidget tools 5 are on each side of the head component 1, near the area where the head component 1 connects to the torso component 10. A pair of arm or sleeve components are on opposite sides of the torso component 10. Each arm component 6*s* contains a seam with zipper pull 21, a thumb hole 8 is shown at the lower edge of the arm sleeve portion, and a bottom hem 15 with drawstrings 13 is shown underneath the front pocket 11 area. The front pocket 11 is shown at the lower portion of the front surface of the Sensory Hoodie. The felled and serged seams are also shown at both lower arm sleeve portions of the Sensory Hoodie. The front pocket 11 also has a pair of front pocket fidget 12 tools at the bottom of the front pocket 11. FIG. 5 is close-up, detail view of the hem and front pocket 11 of the Sensory Hoodie. FIG. 6 is close-up detail of the hood opening and drawstrings of the Sensory Hoodie. The front of the hoodie is shown with drawstrings near the face portion of the Sensory Hoodie.

Figure 2:
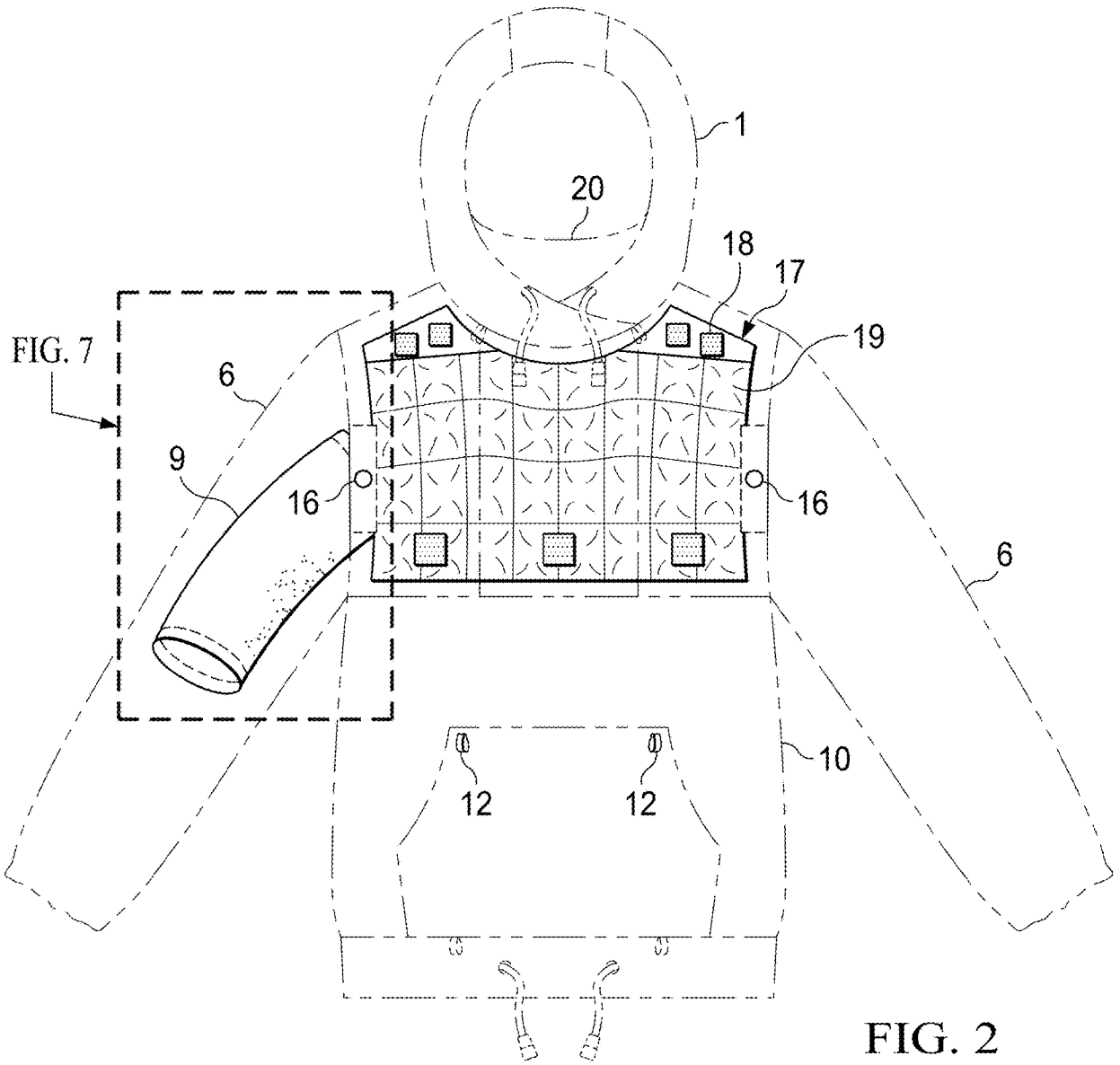
FIG. 2 shows the front portion of the Sensory Hoodie with internal components.

FIG. 2 shows the front portion of the Sensory Hoodie with internal components, specifically the arm compression sleeve 9 and the weighted insert 17. The front surface of the weighted insert 17 is shown with a series of weight pockets 19 (shown as diagonal lines) while the hook and loop fastener (Velcro) attachment points 18 are shown with dotted squares. However, the torso weighted insert attachment means could also be snaps or a similar mechanism for securing the insert to the interior torso material of the garment. The weighted panel inserts are secured to the Sensory Hoodie garment via the attachment means. The weighted panel inserts may cover the torso (front and back). The weighted insert 17 panels are attached to the Sensory Hoodie lining at the attachment points. This view also shows the Sensory Hoodie Arm compression sleeve 9 inside the arm component 6. A first end of the compression sleeve 9 is attached to the torso component 10 via the torso attachment means 16 for compression sleeve 9 with a snap, in this embodiment. However, the attachment means could also be a zipper, hook and loop fastener or a similar mechanism. At the lower end of the torso component 10, a pair of front pocket fidget 12 tools are at the upper edge of the torso pocket. In this view, the front of the hoodie is shown with drawstrings near the face opening 2 of the Sensory Hoodie.

Figure 3:
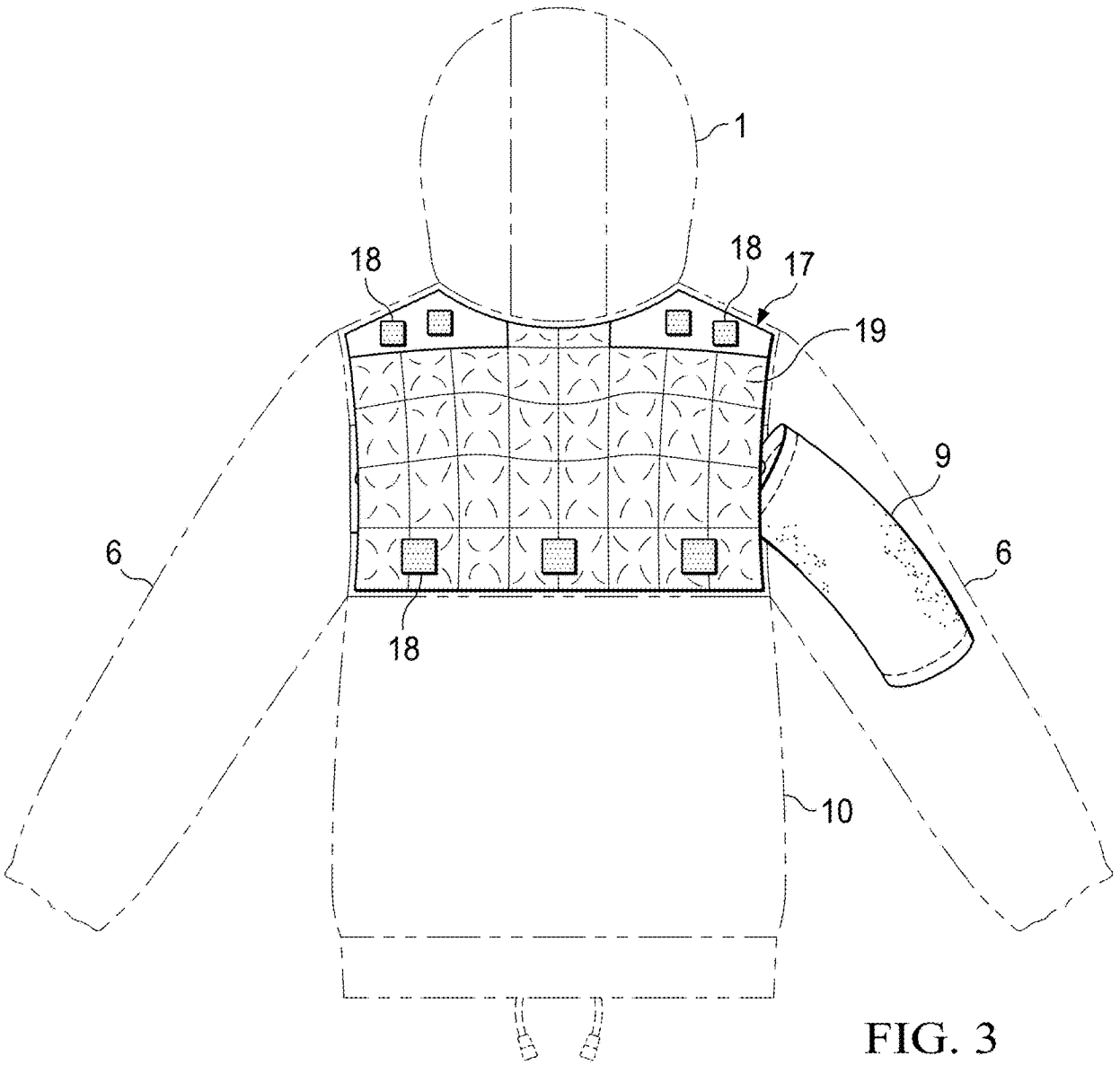
FIG. 3 shows the back portion of the Sensory Hoodie with internal components.

FIG. 3 shows the back portion of the Sensory Hoodie with internal components, specifically the arm compression sleeve 9 and the weighted insert 17. A rear view of the head component 1 is shown. surface of the weighted insert 17 is shown with a series of weight pockets 19 (shown as diagonal lines) while the hook and loop fastener (Velcro) attachment points 18 are shown with dotted squares. The weighted panel inserts are secured to the Sensory Hoodie garment via the attachment means. This view also shows the Sensory Hoodie Arm compression sleeve 9 inside the arm component 6. A first end of the compression sleeve 9 is attached to the torso component 10 via the torso attachment means for compression sleeve 9 with a snap, in this embodiment. At the lower end of the torso component 10, a pair of front pocket fidget 12 tools are at the upper edge of the torso pocket. In this view, the front of the hoodie is shown with drawstrings near the face opening 2 of the Sensory Hoodie. The hoodie rise face 20 covering is above the bottom of the face opening 2 and the head drawstrings 3.

Figure 4:
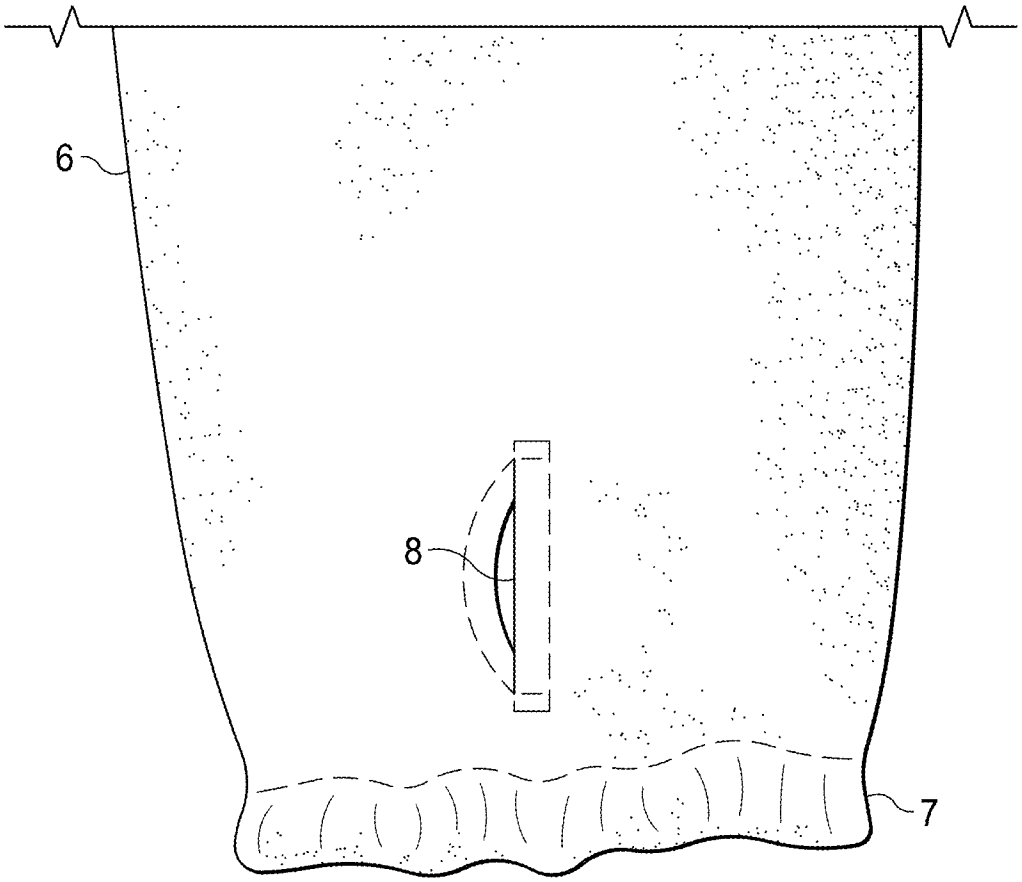
FIG. 4 shows the detail of the lower sleeve of the Sensory Hoodie.

FIG. 4 shows the detail of the lower sleeve of the Sensory Hoodie. The farthest end of the Sensory Hoodie sleeve includes a thumb hole 8 opening and a sleeve hem 7 with felled and serged seams to prevent friction and irritation. The sleeve hem 7 is also constructed from large elastic to prevent tightness around the wrist area of the wearer. The thumb hole 8 is shown at the further edge of the arm sleeve portion. The wearer may choose to keep the majority of their hand covered except for the thumb in the thumb hole 8.

FIG. 5 shows the detail of hem and front pocket 11 of the Sensory Hoodie. The front pocket 11 is shown at the lower portion of the front surface of the Sensory Hoodie. A bottom hem 15 with drawstrings is shown underneath the front pocket 11 area. The bottom hem drawstrings 13 both have bottom hem drawstring 13 tips 14 made of food grade silicone or rubber material that will not be destroyed from chewing or other rough handling. A bottom hem 15 with felled and serged seams to prevent friction and irritation and drawstrings are shown underneath the front pocket 11 area. The bottom or bottom hem drawstring 13 is shown beneath the front pocket 11. The bottom or bottom hem drawstring 13 may be tightened or loosened around the waist area to for a tighter, more secure fitting garment. The front pocket 11 also includes fidget tool loops 12 inside the pocket (hidden from the view of third parties) as well as fidget tool loops 12 outside the pocket and near the hem of the torso portion of the Sensory Hoodie. For example, silicone fidget beads or another fidget toy (not shown) may be attached to the fidget tool loop inside the front pocket 11 to provide relief and distraction for the wearer.

FIG. 6 shows the detail of the Sensory Hoodie face opening 2. The front portion of the head component 1 of the Sensory Hoodie is shown with a front hood rise, to cover the wearer's face. The hood rise is constructed as a component of the Sensory Hoodie component and is located above the bottom edge of the face opening 2 and the head drawstrings 3. A wearer would pull the front hood rise over their mouth and possibly nose to provide a modicum of privacy. The hood rise cover may be extracted and pulled up to cover a portion of the face or pushed down and hidden inside the head opening. The ends of the head drawstrings 3 are made of food grade silicone to protect a wearer who may chew and inadvertently swallow pieces of the drawstring covering. This view of the head component 1 also shows the head fidget tool 5 at the lowest edge of the head component 1, where the head component 1 connects to the torso component 10. These fidget tools may serve as the fidget device.

Figure 7:
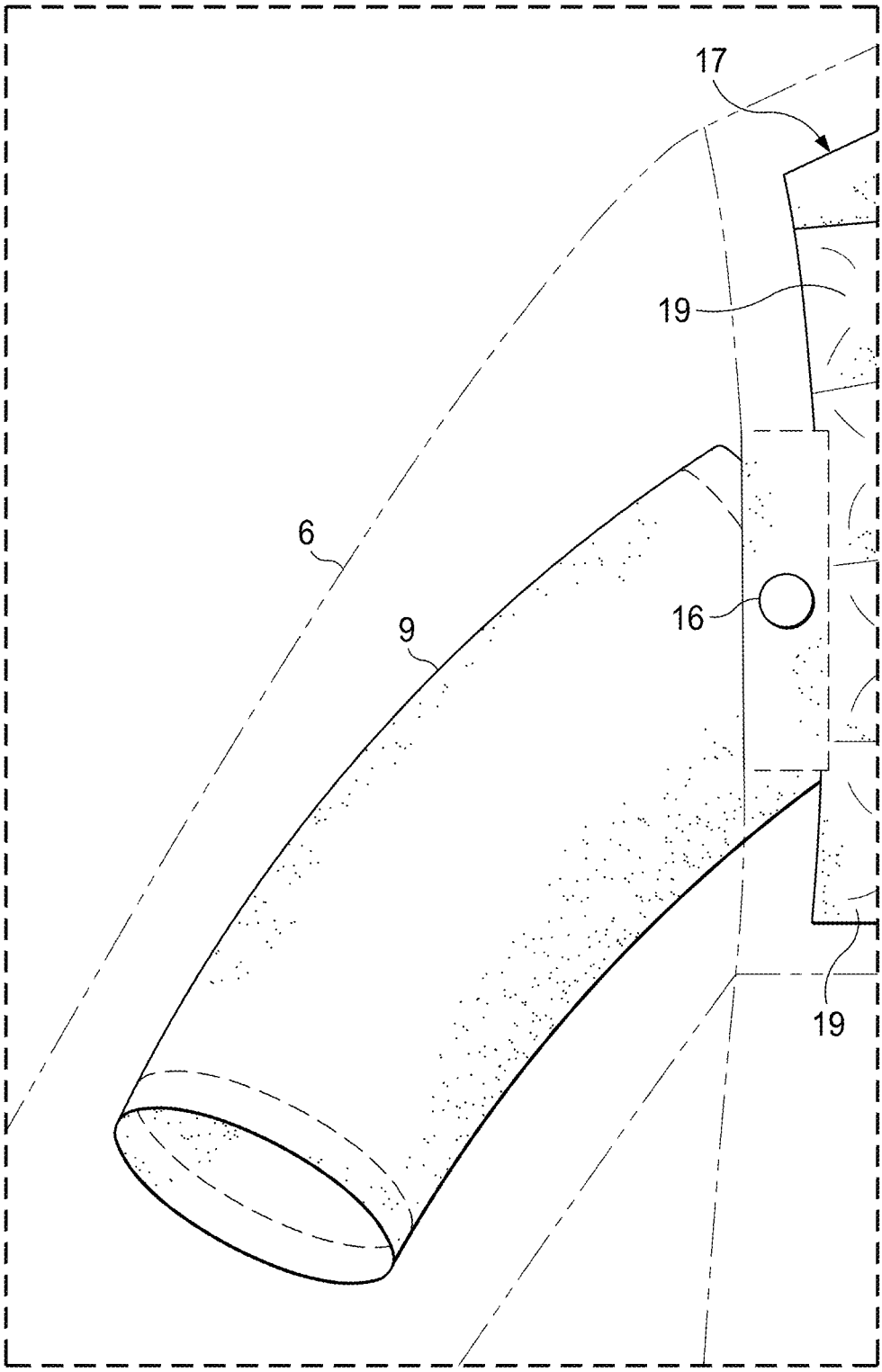
FIG. 7 shows the detail of the upper sleeve of the Sensory Hoodie with arm compression.

FIG. 7 shows the detail of the arm compression sleeve 9 of the Sensory Hoodie. Whether these arm compression sleeves 9 are worn inside the Sensory Hoodie depends on the needs of the wearer and if that person wants their arms compressed or free of tight restrictions. The removeable compression sleeves 9 may be inserted through a seam on the arm that opens with an invisible zipper. The invisible zipper may be accessed by pulling the zipper pull 21 on the seam of the arm component 6. A snap, or other attachment means, 16 may be used to connect the compression sleeve 9 to the torso component 10. The snap 16 can be undone to disconnect the compression sleeve 9 inside the arm component 6 from the torso component 10. This view also shows a portion of the weighted insert 17 on the opposite side of the compression sleeve 9 and on the torso component 10. The weighted insert 17 had a series of weight pockets 19, that can be added and removed to increase or decrease the weight load of the weighted insert 17.

Figure 8:
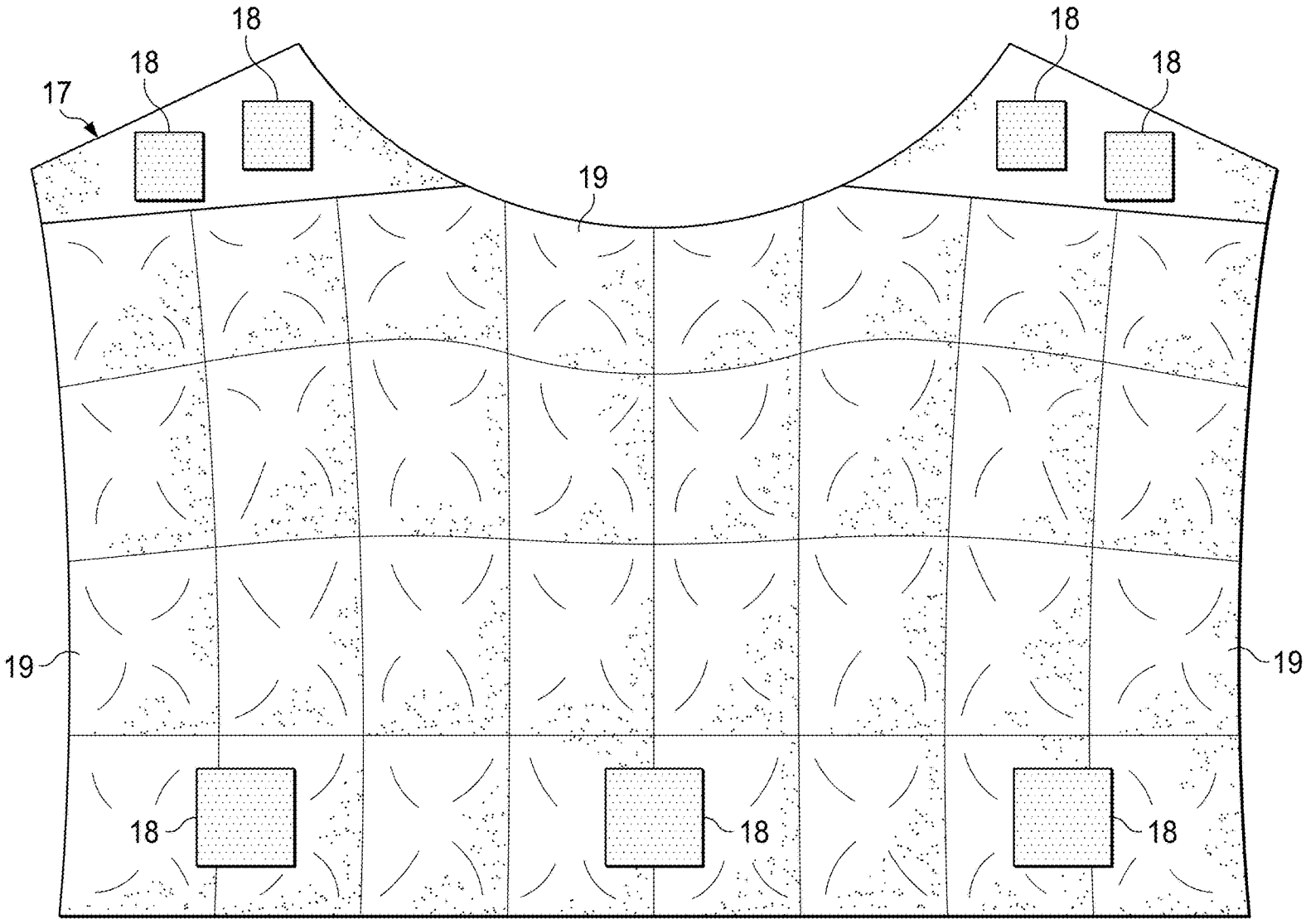
FIG. 8 shows the detail of the weighted insert of the Sensory Hoodie.

FIG. 8 shows the detail of the weighted insert 17 of the Sensory Hoodie. The back surface of the weighted insert 17 is shown with a series of weight pockets 19 (shown as diagonal lines) while the hook and loop fastener (Velcro) attachment points 18 are shown with dotted squares. The weighted panel inserts are secured to the Sensory Hoodie garment via the attachment means. The weighted insert 17 panels are attached to the lining at the attachment points and may be formed with quilted or regular stitching lines. Each pocket created by quilted stitching may contain a certain number of beads or other weighted objects to achieve the desired aggregate weight for a particular weighted panel insert.

What is claimed is:

1. An article of sensory relief clothing, wherein said clothing is comprised of:

a head component comprised of a head covering with a face opening, a head component drawstring surrounding said face opening;

a pair of drawstrings tips at each end of said head component drawstring;

at least one looped length of material attached to the lower edge of said head component; and a face covering element permanently secured to the lower edge of said face opening;

a pair of arm components, further comprised of upper arm elements and lower arm elements;

a torso component, further comprised of an upper torso element and a lower torso element; and a series of sensory relief elements.

2. The sensory relief clothing of claim 1, wherein said pair of arm components is further comprised of:

a first sleeve attached to a first side of said upper torso element, wherein said first sleeve is further comprised of a first sleeve opening and first sleeve opening mechanism; wherein a first arm compression sleeve may be removably attached to a first side of said upper torso element with a first sleeve to torso attachment mechanism;

a second sleeve attached to a second side of said upper torso element; wherein said second sleeve is further comprised of a second sleeve opening and second sleeve opening mechanism; wherein a second arm compression sleeve may be removably attached to a second side of said upper torso element with a second sleeve to torso attachment mechanism.

3. The sensory relief clothing of claim 2, wherein said first sleeve is further comprised of a first thumb hole opening adjacent to the further end of said first sleeve and a first sleeve hem; wherein said second sleeve is further comprised of a second thumb hole opening adjacent to the further end of said second sleeve and a second sleeve hem.

4. The sensory relief clothing of claim 1 wherein said upper torso element is further comprised of front upper torso panel and a back upper torso panel;

wherein said front upper torso panel is further comprised of a front weighted insert panel with a series of front upper torso panel weight pockets and front weighted insert panel attachment means;

wherein said back upper torso panel is further comprised of a back weighted insert panel with a series of back upper torso panel weight pockets and back weighted insert panel attachment means.

5. The sensory relief clothing of claim 1 wherein said lower torso element is further comprised of:

a lower torso front pocket, wherein a lower torso bottom hem with a lower torso drawstring with a pair of drawstring tips at each end of said lower torso drawstring;

at least one looped length of material attached to the exterior of the top edge of said lower torso front pocket;

at least one looped length of material attached to the interior of the bottom edge of said lower torso front pocket.

6. The sensory relief clothing of claim 2, wherein said first sleeve opening mechanism means is selected from the group consisting of: zipper, hook and look fastener, snap closure; wherein said second sleeve opening mechanism means is selected from the group consisting of: zipper, hook and look fastener, and snap closure.

7. The sensory relief clothing of claim 2, wherein said first sleeve to torso attachment mechanism means is selected from the group consisting of zipper, hook and look fastener, and snap closure; wherein said second sleeve to torso attachment mechanism means is selected from the group consisting of zipper, hook and look fastener, and snap closure.

8. The sensory relief clothing of claim 4, wherein a number of weights stored within said weight pockets may be selected from the group consisting of: beads, beans, rice, and metal balls.

9. The sensory relief clothing of claim 1, wherein said sensory relief elements are further selected from the group consisting of: silicone coverings, beads, zippers, weighted panel inserts, compression sleeves, felled seams, serge seams, and fidget toys.

10. A method of providing sensory relief through apparel, wherein a user engages a number of sensory relief features selected from the group consisting of:

pulling a head covering drawstring to tighten a head covering;

raising a head covering rise to cover said user's face;

chewing the tips of said head covering drawstring;

caressing a head covering fidget loop;

inserting a compression sleeve inside said apparel sleeve;

attaching a front torso weighted insert under the front torso of said apparel;

attaching a back torso weighted insert under the back torso of said apparel;

inserting a user's thumb into an apparel sleeve thumb hole inserting a user's hand or hands into a front pocket;

caressing a torso front pocket exterior fidget loop;

caressing a torso front pocket interior fidget loop;

attaching a fidget toy to any fidget loop of said apparel;

pulling a torso hem drawstring to tighten said apparel.

* * * * *